United States Patent [19]

Miller et al.

[11] Patent Number: 4,940,136

[45] Date of Patent: Jul. 10, 1990

[54] FINGERNAIL CLIPPER POUCH

[75] Inventors: Joseph T. Miller, Mehlville; Edward F. Brown, Bonne Terre, both of Mo.

[73] Assignee: Mocap, St. Louis, Mo.

[21] Appl. No.: 375,342

[22] Filed: Jul. 3, 1989

[51] Int. Cl.[5] ..... A45D 29/00; A45C 15/00

[52] U.S. Cl. ..... 206/38.1; 30/28; 132/75; 132/75.5; D28/60

[58] Field of Search ..... 206/38, 37, 37.1, 37.8, 206/349, 38.1; 30/26, 28; D28/60; 132/75, 75.4, 75.5

[56] References Cited

U.S. PATENT DOCUMENTS

| | | | |
|---|---|---|---|
| D. 198,660 | 7/1964 | Britton | D28/60 |
| 1,525,344 | 2/1925 | Viegelmann | 206/37 R |
| 2,125,354 | 8/1938 | Meier | 206/37 X |
| 2,829,433 | 4/1958 | Killen | D28/60 X |
| 2,887,773 | 5/1959 | Killen | 30/28 |
| 3,119,429 | 1/1964 | Stiller et al. | 206/37 X |
| 3,160,186 | 12/1964 | Conley | 206/38.1 |
| 3,261,094 | 7/1966 | Bliss | 132/75.5 X |
| 3,316,632 | 5/1967 | Bowers | 30/28 |
| 3,613,416 | 10/1971 | Paton | 206/37.1 |
| 3,855,698 | 12/1974 | Crosby | 132/75.4 |
| 3,918,503 | 11/1975 | Bundy | 206/38.1 |
| 4,017,923 | 4/1977 | Schantz | 132/75.4 X |
| 4,166,489 | 9/1979 | Lemelson | 206/38.1 |
| 4,550,496 | 11/1985 | Reinicke | 30/28 X |
| 4,577,754 | 3/1986 | Jones | 206/349 |

FOREIGN PATENT DOCUMENTS

| | | | |
|---|---|---|---|
| 2809220 | 9/1979 | Fed. Rep. of Germany | 132/75.4 |

*Primary Examiner*—William Price

*Attorney, Agent, or Firm*—Paul M. Denk

[57] ABSTRACT

A fingernail clipper pouch for use with a key ring or the like is disclosed as including an elongated one-piece receptacle formed of resilient and flexible material. The receptacle includes an interior compartment generally configured to the shape of fingernail clipper, one end of the receptacle being closed and the other and being open for entry and removal of the fingernail clipper. The closed end of the receptacle is attached to the key ring while the open end has a restricted throat opening that is capable of being resiliently enlarged when the receptacle is temporarily deformed by squeezing thereof to facilitate removal of the fingernail clipper from the receptacle.

12 Claims, 1 Drawing Sheet

FINGERNAIL CLIPPER POUCH

CROSS REFERENCE TO RELATED APPLICATIONS

This application is related to prior copending utility patent application Ser. No. 07/307,920, filed Feb. 9, 1989, entitled "COIN POUCH"; and copending utility patent application having Ser. No. 375,341, filed on July 3, 1989, entilted "MIRROR POUCH"; and, copending design patent application having Ser. No. 375,343, filed on July 3, 1989, entitled "FINGERNAIL CLIPPER POUCH", all of said applications being owned by a common assignee.

BACKGROUND OF THE INVENTION

The present invention relates to a fingernail clipper pouch for use with a key ring or the like, and more particularly relates to an integral one-piece receptacle constructed of resilient and flexible material, preferably elastomeric material, with a closed end and an open end, the open end having a restricted throat opening to prevent unauthorized removal of the fingernail clipper from the receptacle, while the receptacle is also capable of being temporarily deformed so as to force the fingernail clipper into and through the restricted opening for removal of the fingernail clipper relative to the receptacle.

At the present time, fingernail clippers are either carried in a user's pocket or purse or are stored in a drawer in the user's home or office. When carried in the user's pocket or purse, the fingernail clippers are commonly carried separately from a key ring or key chain primarily because it is difficult to operate the fingernail clipper when attached to a key ring or key chain. In such instances, the fingernail clipper is preferably removed from the key ring or key chain in order to enable the user to properly and effectively use the fingernail clippers, without interference from dangling keys from the key ring or key chain. When carried separately from the key ring or key chain, which is the typical manner of carrying fingernail clippers, the fingernail clipper can be easily separated and lost from the user because they do not generally attract the user's attention, except when it is desired to use same. This problem could be alleviated by using the hole provided in most fingernail clippers to mount the fingernail clippers to a key ring or key chain; however, as noted above, most users prefer not to do this because the fingernail clippers are difficult to operate when mounted on the key ring or key chain.

In my aforementioned "COIN PURSE" copending patent application, I have disclosed an inherently resilient body or enclosure which may be temporarily deformed for the insertion or removal of coins, as may be desired. Also, in my aforementioned "MIRROR POUCH" copending patent application, I have disclosed a similarly constructed resilient and flexible enclosure or receptacle which may be opened and closed to receive a complementary shaped mirror. In both aforementioned designs, the pouch is constructed for use with a key ring or the like, to allow car and home keys to be positioned in overlapping relationship to the pouch for convenient carrying and storage thereof.

The present invention is directed to a fingernail clipper pouch which, unlike either of the designs in m aforementioned copending patent applications, is specifically and uniquely constructed to resiliently hold a fingernail clipper in place until it is desired to use same, whereupon temporary deformation of the fingernail clipper pouch enables the fingernail clipper to be readily withdrawn and removed therefrom, as well as re-inserted therein. The fingernail pouch, like the pouches in my aforementioned copending patent applications, is also preferably associated with a key ring or the like to position keys in proximate relationship thereto for convenient carrying and storage thereof.

SUMMARY OF THE INVENTION

Among the several objects and advantages of the present invention include:

The provision of a new and improved fingernail clipper pouch for use with a key ring or the like which provides convenient accessibility to the use of the fingernail clipper, while at the same time enabling convenient storage in proximity to the key ring or the like;

The provision of the aforementioned fingernail clipper pouch which provides convenient opening by one-handed manipulation thereof;

The provision of the aforementioned fingernail clipper pouch which is constructed of a material, as well as formed in such a shape, such that it can be temporarily deformed to facilitate removal and/or entry of fingernail clippers relative thereto;

The provision of the aforementioned fingernail clipper pouch which includes a flexible restricted throat opening to releasably secure the fingernail clippers in place within the pouch until it is desired to remove same, whereupon simple squeezing and temporary deformation of the pouch forces the fingernail clippers through and past the flexible restricted throat opening for removal of the fingernail clipper therefrom;

The provision of the aforementioned fingernail clipper pouch for use with an associated key ring which are pivotally and foldably connected relative to one another to facilitate positioning keys mounted on the key ring to be proximately located relative to the fingernail clipper pouch carrying the fingernail clipper, for convenient carrying and storage of same; and The provision of the aforementioned fingernail clipper pouch which is compact and efficiently constructed; simple and easy to use, can be used multiple times without substantial wear or deterioration; protects the fingernail clippers against nicks or other damaging blows; and is otherwise well adapted for the purposes intended.

Briefly stated, the fingernail clipper pouch of the present invention is adapted for use with a key ring or the like and includes an integral one-piece receptacle constructed of resilient and flexible material. The receptacle has an elongated shape with opposed ends and an interior compartment generally configured to the shape of a fingernail clipper adapted to receive therein. One end of the receptacle is closed and the other end is open for entry and removal of the fingernail clipper associated therewith. The closed end of the receptacle is attached to the key ring or the like and the open end has a restricted throat opening to prevent unauthorized removal of the fingernail clipper from the receptacle.

The restricted throat opening is capable of being resiliently enlarged by squeezing and temporarily deforming the receptacle, including interior compartment thereof, so as to force the fingernail clipper into and through the restricted opening for removal therefrom. The restricted throat opening as defined by a flexible flap which extends across part of the opening so as to provide flexible yielding and enlargement of the opening when a fingernail clipper is forced thereagainst. The flexible flap of the restricted throat opening is associated with a configured end surface of the receptacle that engages and holds a fingernail clipper within the interior compartment thereof until removed therefrom. The configured end surface depends from an upper receptacle wall and is integrally connected to receptacle sidewalls so as to partially closed off the restricted throat opening with the flexible flap being attached to a lower end of the configured end surface, while also being attached to the receptacle sidewalls.

The key ring and receptacle are pivotally and foldably connected to one another to position the key ring and receptacle in generally overlapped relationship for convenient carrying or storage thereof. A U-shaped link member pivotally and foldably secures the key ring to the receptacle at the closed end thereof. The U-shaped link includes depending legs which are secured at the outer free ends to each other through the receptacle in order to secure the link to the receptacle, and with the key ring being pivotally and foldably received within the U-shaped link, when secured to the receptacle. The receptacle itself is constructed in its unique shape from a polyvinyl chloride material which provides the desired flexibility and resiliency to accomplish the foregoing.

These and other objects and advantages of the present invention will become apparent from the ensuing description.

DESCRIPTION OF THE PREFERRED EMBODIMENT

Figure 1:
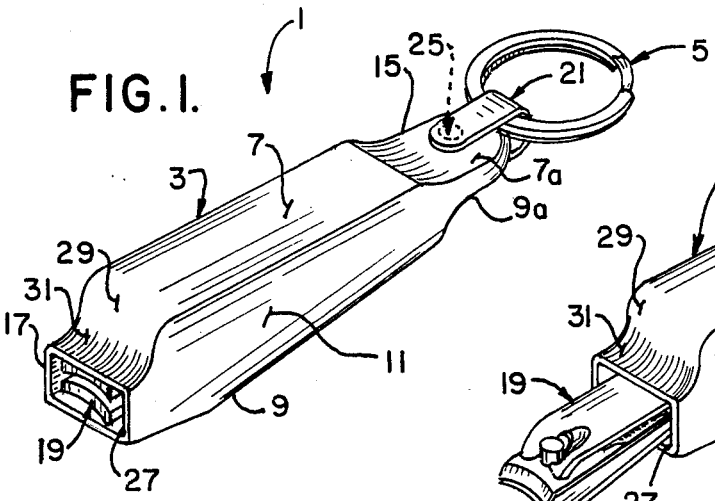
FIG. 1 is an isometric view of a fingernail clipper pouch constructed in accordance with the present, including an associated key ring.

The following detail description illustrates the invention by way of example and not by way of limitation. The description will clearly enable one skilled in the art to make and use the invention, and describes several embodiments, adaptions, variations, alternatives and uses of the invention, including what we presently believe is the best mode of carrying out the invention.

In the drawings, the fingernail clipper pouch 1 includes an integral one-piece enclosure or receptacle 3 for use with a key ring 5 or the like such as a key chain or other equivalent structure. The enclosure or receptacle 3 is constructed of a resilient and flexible material, preferably polyvinyl chloride, through custom polymer molding methods and techniques that are well known in the molding art.

Figure 2:
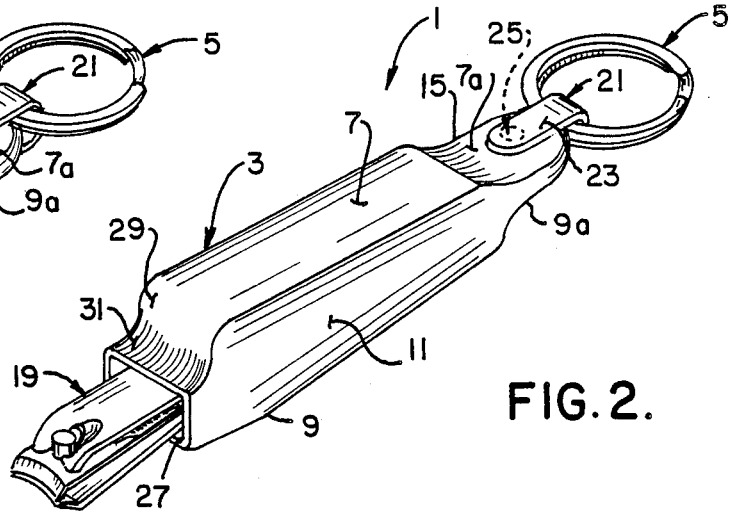
FIG. 2 is an isometric view of the fingernail clipper pouch and illustrating in the manner in which an associated fingernail clipper may be inserted and removed through the restricted throat opening in the fingernail clipper pouch.
Figure 3:
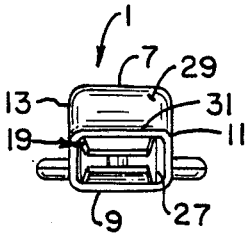
FIG. 3 is a front end elevational view of the pouch shown in FIG. 1.

While the enclosure or receptacle 3 is formed form a resilient and flexible material, for reasons which will become apparent, the enclosure or receptacle 3 is also formed in a self-supporting elongated shape as illustrated in the drawings. Specifically, the enclosure or receptacle 3 includes spaced upper and bottom walls 7, 9 respectively and spaced side walls 11, 13 which integrally connected the upper and bottom wall 7, 9 together as the integral one-piece enclosure or receptacle 3. It will be further noted that the upper wall 7 tapers from one closed end 15 of the receptacle to the opposite end 17 which includes an opening for entry and removal of the fingernail clipper 19, as best seen in FIG. 2 of the drawings.

Figure 4:
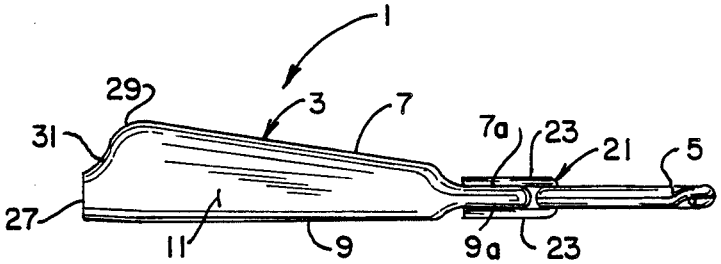
FIG. 4 is a side elevational view thereof.
Figure 5:
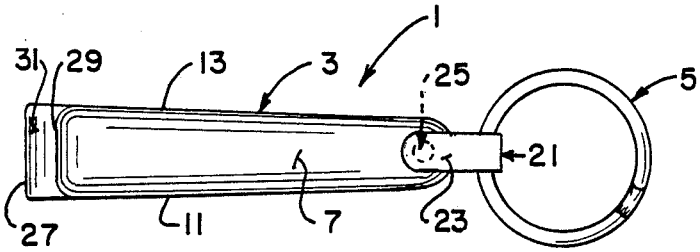
FIG. 5 is a top plan view thereof.
Figure 7:
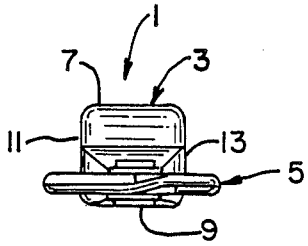
FIG. 7 is a rear elevational view thereof.
Figure 6:
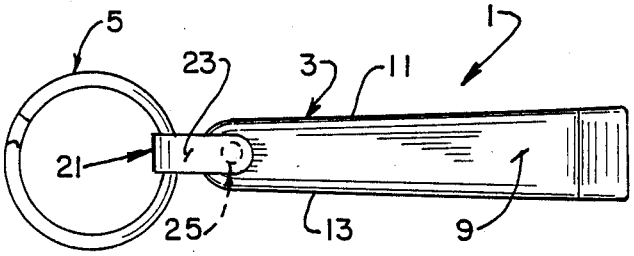
FIG. 6 is a bottom plan view thereof.

At the closed end 15 of the receptacle 3, the upper and bottom wall sections *7a*, *9a* thereof are flatted for receiving the U-shaped link 21 that pivotally and foldably secures the key ring 5 to the receptacle 3 at the closed end 15 thereof. Specifically, the link 21 includes identical spaced and opposed depending legs 23, 23 which straddle the closed end 15 of the receptacle 3 in overlying relationship to the flattened top wall and bottom wall sections *7a*, *9a* thereof, with the depending legs 23, 23 being secured at the outer free ends thereof as well as being secured to the receptacle 3 by suitable complementary fastening, rivet or other securement means 25 as best seen in FIGS. 4–5 of the drawings. There is sufficient space between the outermost edge of the closed end 15 and the key ring 5 to enable the key ring 5 to be pivotally and rotatably mounted relative to the receptacle 3, while also being foldably connected thereto, allowing keys secured to the key ring 5, or its equivalent, to be positioned in overlapped relationship for convenient carrying and storage of the fingernail clipper pouch with associated keys in a user's pocket or purse, as will be apparent.

The foregoing explanation makes it apparent that the enclosure or receptacle 3 is not only a self-supporting member with an interior compartment fully configured to the shape of the fingernail clipper 19 for reception therein, but the elongated and formed shape of the enclosure or receptacle 3, together with the resilient and flexible material from which the enclosure or receptacle 3 is made, permits a user to bend or squeeze the receptacle 3 in the vicinity of the closed end 15 thereof in order to remove the fingernail clipper 19 from the receptacle 3. Specifically, and for this purpose, the open end 17 of the receptacle 3 includes a restricted throat opening 27 which prevents unauthorized and untimely removal of the fingernail clipper 19 from the receptacle 3, but is capable of being resiliently enlarged by squeezing and temporarily deforming the receptacle 3 beginning adjacent the closed end thereof causing deformation of the interior compartment containing the fingernail clipper 19 and forcing the fingernail clipper 19 into and through the restricted opening 27 for removal from the receptacle 3.

A configured end surface 29, generally conforming to the enlarged area of the fingernail clippers 19, also includes a flexible flap at 31 extends across part of the restricted throat opening 27 to provide flexible yielding and enlargement of the restricted throat opening when a fingernail clipper 19 is forced thereagainst. The configured end surface 29 depends from the upper wall 7 and is integrally connected between the sidewalls 11, 13 so as to partially close off and provide the restricted throat opening 27. The flexible flap 31 is attached to the lower end of the configured end surface 29, while also being attached to the sidewalls 11, 13. It will be apparent that as the fingernail clipper 19 is forced through the restricted throat opening 27, as the result of squeezing or bending the receptacle 3 in the vicinity of the closed end 15, the flexible flap 31 by itself will yield, or the flexible flap 31 together with the configured end surface 29, will deform and yield to enable the restricted throat opening 27 to be resiliently enlarged, as a result of the receptacle 3 being made of a resilient and flexible material, enabling the fingernail clippers 19 to be moved through and past the restricted throat opening for removal from the receptacle 3. Re-entry of the fingernail clippers is a simple matter by inserting the smaller end of the fingernail clippers first through the restricted throat opening and then allowing the remainder of the fingernail clippers 19 to pass through the restricted throat opening 27, including partial enlargement or deformation of the restricted throat opening as the enlarged end or head of the fingernail clippers 19 is moved pass the restricted throat opening 27.

In selecting the type of material formulations used for the polymer to provide the resilient and flexible characteristics that are desired, consideration must be given to the texture, hardness, color reception, material thickness, in addition to endurance, after sustained usage. As has been discussed above, polyvinyl chloride typically meets such characteristics, and can be manufactured with the desired hardness and thickness required. Furthermore, the use of vinyl material in the fingernail clipper pouch 1 of the present invention enables imprinted or bonded messages, company names, product advertising or other suitable indicia to be printed on the exposed polymer surfaces of the fingernail clipper pouch. By using glossy ink applied to the polymer surfaces, it gives the appearance of a two part molding, also creating a rather lasting impression. In addition, any ink applied to this type of vinyl material, resists wear, fading, flexing and deterioration, even when in contact with certain types of chemicals.

From the foregoing, it will now be appreciated that the fingernail clipper pouch of the present invention is uniquely constructed to provide convenient access and availability of a fingernail clipper when desired, while also storing same in the enclosure or receptacle attached to a key ring or other equivalent structure, facilitating carrying and storage thereof.

Variations or modifications to the subject matter of this invention may occur to those skilled in the art upon reviewing the invention as described herein. Such variations or modifications, if within the spirit of this invention are intended to be encompassed within the scope of any claims to patent protection issuing upon this development. The description of the preferred embodiments set forth herein is done so for illustrative purposes only.

We claim:

1. A fingernail clipper pouch comprising an integral one-piece receptacle constructed of resilient and flexible material, said receptacle having an elongated shape with opposed ends and an interior compartment generally configured to the shape of a fingernail clipper adapted to be received therein, one end of said receptacle being closed and the other being open for entry and removal of the fingernail clipper associated therewith, and said open end having a restricted throat opening to restrict unauthorized removal of the fingernail clipper from said receptacle, said pouch entirely enclosing the clipper along its entire length when inserted therein.

2. The pouch as defined in claim 1 wherein said restricted throat opening is capable of being resiliently enlarged by squeezing and temporarily deforming the receptacle including interior compartment thereof so as to force the fingernail clipper into and through the restricted opening for removal therefrom.

3. A fingernail clipper pouch comprising an integral one-piece receptacle constructed of resilient and flexible material, said receptacle having an elongated shape with opposed ends and an interior compartment generally configured to the shape of a fingernail clipper adapted to be received therein, one end of said receptacle being closed and the other end being open for entry and removal of the fingernail clipper associated therewith, and said open end having a restricted throat opening to restrict unauthorized removal of the fingernail clipper from said receptacle, said restricted throat opening is capable of being resiliently enlarged by squeezing and temporarily deforming the receptacle including interior compartment thereof so as to force the fingernail clipping into and through the restricted opening for removal therefrom, said restricted throat opening being defined by a flexible flap which extends across part of said opening so as to provide flexible yielding and enlargement of said opening when a fingernail clipper is forced thereagainst.

4. The pouch as defined in claim 3 wherein the flexible flap of said restricted throat opening is associated with a configured end surface that engages and holds a fingernail clipper within said interior compartment until removed therefrom.

5. The pouch as defined in claim 4 including spaced upper and bottom walls and spaced sidewalls integrally connecting the upper and bottom walls together as said integral one-piece receptacle.

6. The pouch as defined in claim 5 wherein the configured end surface depends from the upper wall and is integrally connected between said sidewalls so as to partially close off said restricted throat opening, said flexible flap being attached to a lower end of said configured end surface while also being attached to said sidewalls.

7. The pouch as defined in claim 6 including a key ring or the like attached to the closed end of said receptacle.

8. The pouch as defined in claim 7 wherein said key ring and said receptacle are pivotally and foldably connected to one another to position said key ring and receptacle in generally overlapped relationship for convenient carrying or storage thereof.

9. The pouch as defined in claim 8 and including a link pivotally and foldably securing said key ring to said receptacle at the closed end thereof.

10. The pouch as defined in claim 9 wherein said link is a U-shaped member having depending legs which straddle the receptacle, said depending legs being secured at outer free ends thereof to each other through said receptacle to secure the link to said receptacle, said key ring being pivotally and foldably received within the U-shaped link when secured to said receptacle.

11. The pouch as defined in claim 10 wherein said receptacle is formed from a polymer material.

12. The pouch as defined in claim 11 wherein said polymer is a polyvinyl chloride material.

* * * * *